US012571134B2

(12) United States Patent
Lee et al.

(10) Patent No.: US 12,571,134 B2
(45) **Date of Patent: *Mar. 10, 2026**

(54) POLYETHYLENE YARN WITH IMPROVED WEAVING PROPERTIES AND FUNCTIONAL FABRIC INCLUDING THE SAME

(71) Applicant: KOLON INDUSTRIES, INC., Seoul (KR)

(72) Inventors: Young Soo Lee, Seoul (KR); Jung Eun Park, Seoul (KR); Seong-Young Kim, Seoul (KR); Sinho Lee, Seoul (KR)

(73) Assignee: KOLON INDUSTRIES, INC., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 18/713,475

(22) PCT Filed: Dec. 1, 2022

(86) PCT No.: PCT/KR2022/019382

§ 371 (c)(1),
(2) Date: May 24, 2024

(87) PCT Pub. No.: WO2023/101474

PCT Pub. Date: Jun. 8, 2023

(65) Prior Publication Data

US 2025/0034760 A1 Jan. 30, 2025

(30) Foreign Application Priority Data

Dec. 2, 2021 (KR) ..... 10-2021-0170790

(51) Int. Cl.
*D02G 3/02* (2006.01)
*D03D 13/00* (2006.01)
(Continued)

(52) U.S. Cl.
CPC ..... *D02G 3/02* (2013.01); *D03D 13/008* (2013.01); *D03D 15/283* (2021.01);
(Continued)

(58) Field of Classification Search
None
See application file for complete search history.

(56) References Cited

U.S. PATENT DOCUMENTS

2010/0136310 A1 6/2010 Chevillard
2014/0000007 A1 1/2014 Fukushima
(Continued)

FOREIGN PATENT DOCUMENTS

JP 2010-236130 A 10/2010
JP 2012-510570 A 5/2012
(Continued)

OTHER PUBLICATIONS

The Office Action dated Apr. 22, 2025, of the corresponding Japanese Patent Application.
(Continued)

*Primary Examiner* — Arti Singh-Pandey
(74) *Attorney, Agent, or Firm* — Harvest IP Law, LLP

(57) ABSTRACT

Provided are a polyethylene yarn having improved weaving properties and a functional fabric including the same, and more particularly, a polyethylene yarn which may provide a user with an appropriate cool feeling and excellent wearability and allow manufacture of a fabric having a very low fluff occurrence frequency, and a functional fabric including the same are provided.
The polyethylene yarn has a polydispersity index (PDI) of 5 or more and 20 or less, a strength of 1.5 to 10 g/d as measured according to ASTM D2256, and an elongation at maximum force of 10 to 50%.

10 Claims, 4 Drawing Sheets

(51) Int. Cl.
*D03D 15/283* (2021.01)
*D03D 15/573* (2021.01)

(52) U.S. Cl.
CPC ..... *D03D 15/573* (2021.01); *D10B 2321/021* (2013.01); *D10B 2401/04* (2013.01); *D10B 2401/063* (2013.01); *D10B 2501/00* (2013.01)

(56) References Cited

U.S. PATENT DOCUMENTS

| | | | | |
|---|---|---|---|---|
| 2022/0380948 | A1* | 12/2022 | Kim | D01D 5/098 |
| 2023/0322979 | A1* | 10/2023 | Lee | C08F 110/02 526/352 |
| 2023/0357965 | A1* | 11/2023 | Lee | D02G 3/02 |
| 2023/0357966 | A1* | 11/2023 | Lee | D01F 6/04 |
| 2023/0371626 | A1* | 11/2023 | Chung | A61F 7/02 |
| 2023/0392296 | A1* | 12/2023 | Lee | D01F 6/04 |
| 2025/0011976 | A1* | 1/2025 | Lee | D02J 1/22 |

FOREIGN PATENT DOCUMENTS

| | | | |
|---|---|---|---|
| JP | 2015-071840 | A | 4/2015 |
| JP | 2015-089979 | A | 5/2015 |
| JP | 2023-548825 | A | 11/2023 |
| KR | 10-1981759 | B1 | 5/2019 |
| KR | 10-2020-0002119 | A | 1/2020 |
| KR | 10-2020-0036171 | A | 4/2020 |
| KR | 10-2020-0043089 | A | 4/2020 |
| TW | 202124796 | A | 7/2021 |
| WO | 2012-117596 | A1 | 9/2012 |
| WO | 2022-092854 | A1 | 5/2022 |

OTHER PUBLICATIONS

The extended European Search Report dated Jul. 11, 2025, of the corresponding European Patent Application.
The Notice of Allowance dated Sep. 30, 2025 of the corresponding Japanese Patent Application.

* cited by examiner

【FIG. 1】
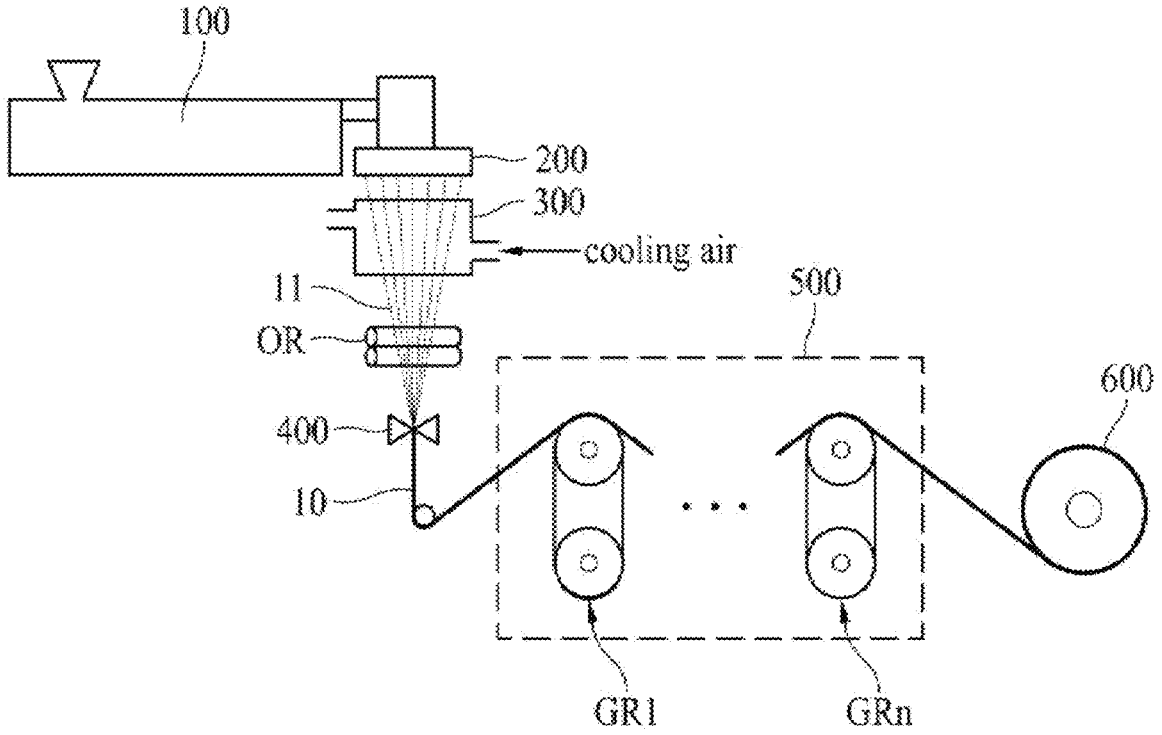

【FIG. 2】
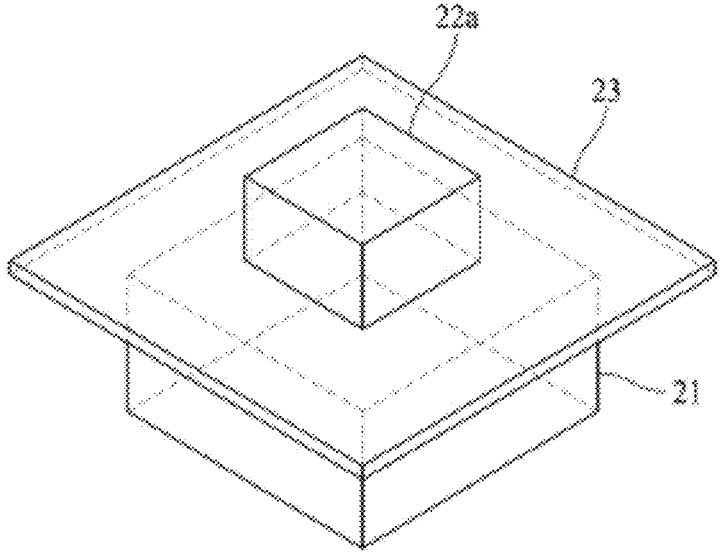

【FIG. 3】
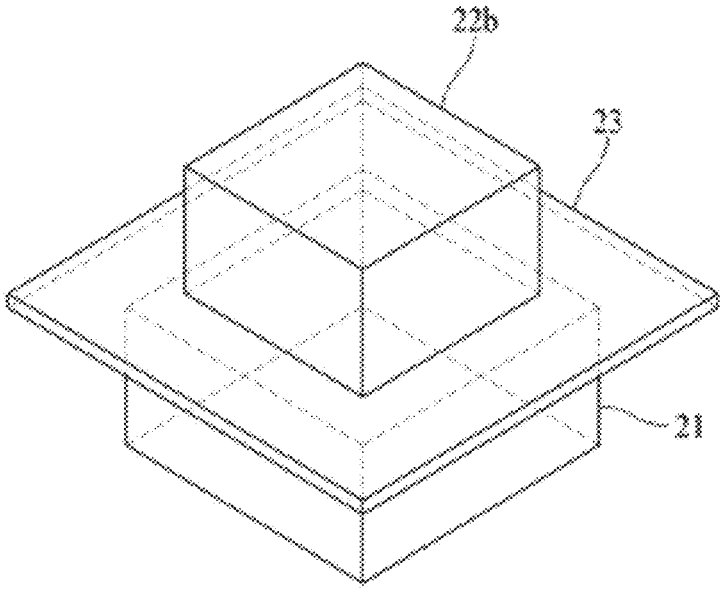

【FIG. 4】
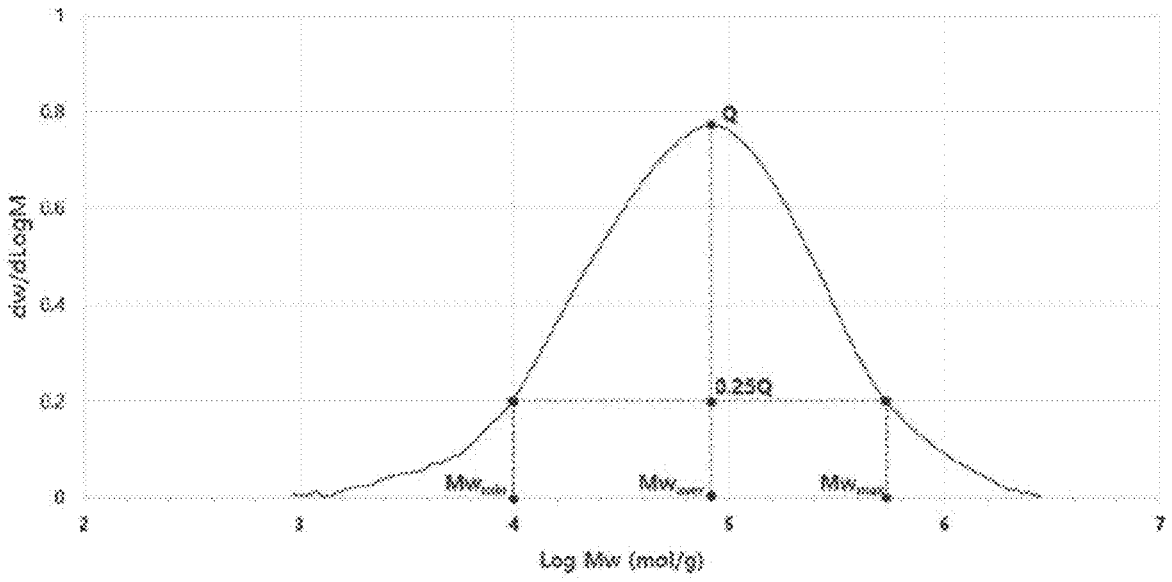

POLYETHYLENE YARN WITH IMPROVED WEAVING PROPERTIES AND FUNCTIONAL FABRIC INCLUDING THE SAME

CROSS REFERENCE TO RELATED APPLICATIONS

This application is a National Stage of International Application No. PCT/KR2022/019382 filed on Dec. 1, 2022, claiming priority based on Korean Patent Application No. 10-2021-0170790 filed on Dec. 2, 2021, the disclosures of which are incorporated herein by reference in their entireties.

TECHNICAL FIELD

The following disclosure relates to a polyethylene yarn having improved weaving properties and a functional fabric including the same, and more particularly, to a polyethylene yarn having improved weaving properties, which may provide a user with an appropriate cool feeling and excellent wearability and allow manufacture of a fabric having a very low fluff occurrence frequency, and a functional fabric including the same.

BACKGROUND ART

In recent years, due to improvements in living standards, population growth, and the like, a fiber demand is changing from general purpose yarn for general clothing and industrial fiber to high-function and high-performance, advanced fiber materials having various functions. In particular, development of a fiber material having a cool feeling to impart a comfort feeling to a user in summer or in a high-temperature working environment is actively in progress.

A cool feeling is imparted to a cool feeling fiber material by using thermal conductivity of the fiber itself, or by adjusting thermal conductivity on the surface of the fiber material by a coating of a metal component having a high thermal conductivity and the like. In particular, a cool feeling fiber material using the thermal conductivity of the fiber itself may be manufactured only by a weaving process of a fabric and may maintain the cool feeling even after washing, and thus, is produced substantially in various industrial fields.

Conventionally, attempts are being made to apply a cool feeling fiber material using the thermal conductivity of the fiber itself to various fields of technical fiber and fashion clothing requiring a high cool feeling such as sportswear, climbing clothes, and working clothes, using excellent thermal conductivity of a high molecular weight polyethylene (HMWPE) fiber, as disclosed in Japanese Patent Registration Publication No. JP 2010-236130 A and Korean Patent Laid-Open Publication No. 10-2017-0135342.

However, since the conventional high molecular weight polyethylene fiber is manufactured as a yarn by maximizing crystallinity and an orientation degree for cool feeling expression, it has high strength. Thus, it has disadvantages of poor weaving properties due to its low elongation and relatively poor wearability of the manufactured fabric due to its low flexibility.

DETAILED DESCRIPTION OF THE INVENTION

Technical Problem

An embodiment of the present invention is directed to providing a polyethylene yarn having improved weaving properties which may provide a user with an appropriate cool feeling and excellent wearability and allow manufacture of a fabric having a very low fluff occurrence frequency, and afunctional fabric including the same.

Technical Solution

In one general aspect, a polyethylene yarn having a polydispersity index (PDI) of 5 or more and 20 or less, a strength of 1.5 to 10 g/d as measured according to ASTM D2256, and an elongation at maximum force of 10 to 50% is provided.

In the polyethylene yarn according to an exemplary embodiment of the present invention, the polyethylene yarn satisfies the following Equation 1 in a weight distribution graph by gel permeation chromatograph (GPC) analysis, with a log scale of a molecular weight (Mw) on the x-axis against a weight distribution (dw/d Log M) on the y-axis, and the weight distribution graph may be unimodal:

$$(Mw_{max} - Mw_{aver}) < (Mw_{aver} - Mw_{min}) \quad \text{[Equation 1]}$$

wherein $Mw_{aver}$ is a molecular weight having a maximum molecular weight distribution in the weight distribution graph, $Mw_{max}$ and $Mw_{min}$ refer to two molecular weights corresponding to 0.25Q in the weight distribution graph, for a weight distribution value Q at $Mw_{aver}$, and $Mw_{max}$ refers to a maximum value of the two molecular weights and $Mw_{min}$ refers to a minimum value of the two molecular weights.

In the polyethylene yarn according to an exemplary embodiment of the present invention, the yarn may have an initial modulus of 30 to 80 g/d as measured according to ASTM 2256.

In the polyethylene yarn according to an exemplary embodiment of the present invention, the yarn may have a crystallinity of 65 to 85%.

In the polyethylene yarn according to an exemplary embodiment of the present invention, the yarn may have a density of 0.93 to 0.97 g/cm$^3$.

In the polyethylene yarn according to an exemplary embodiment of the present invention, the yarn may have a weight average molecular weight of 90,000 to 400,000 g/mol.

In another general aspect, a polyethylene fabric includes the polyethylene yarn described above.

In the polyethylene fabric according to an exemplary embodiment of the present invention, the fabric may have a cool feeling on contact of 0.18 to 0.30 W/cm$_2$, as measured by bringing the fabric at 20±2° C. into contact with a hot plate (T-box) at 30±2° C. under the conditions of 20±2° C. and 65±2% R.H.

In the polyethylene fabric according to an exemplary embodiment of the present invention, the fabric may have a thermal conductivity of 0.05 to 0.20 W/mK, as measured by bringing the fabric at 20±2° C. into contact with a heat source plate (BT-box) at 30±2° C. under the conditions of 20±2° C. and 65±2% R.H.

In the polyethylene fabric according to an exemplary embodiment of the present invention, the fabric may have the number of fluff occurrences of 10 or less per 100,000 m$^2$.

In the polyethylene fabric according to an exemplary embodiment of the present invention, the fabric may have a surface density of 150 to 800 g/m$^2$.

In still another general aspect, a cool feeling product manufactured from the fabric described above is provided.

Advantageous Effects

The polyethylene yarn according to the present invention has both excellent thermal conductivity and improved weaving properties, and thus, may be manufactured into a fabric having a very low fluff occurrence frequency while having appropriate cool feeling properties.

In addition, the functional fabric according to the present invention includes a polyethylene yarn having excellent thermal conductivity and high weaving properties, and thus, may have excellent quality with cool feeling properties and fewer defects such as fluff.

In addition, the functional fabric according to the present invention has excellent drapability as well as a cool feeling, and thus, when a user wears a product made of the fabric as such, a substantially better cool feeling effect may be exerted due to a larger contact area between the user and the product.

BRIEF DESCRIPTION OF DRAWINGS

FIG. 1 is a schematic diagram which schematically illustrates a device for manufacturing a polyethylene yarn according to an exemplary embodiment of the present invention.

FIG. 2 is a schematic diagram which schematically illustrates a device for measuring a cool feeling on contact with a fabric.

FIG. 3 is a schematic diagram which schematically illustrates a device for measuring thermal conductivity in a thickness direction of a fabric.

FIG. 4 is a weight distribution graph by GPC analysis of the polyethylene yarn according to an exemplary embodiment of the present invention.

DESCRIPTION OF EMBODIMENTS

Technical terms and scientific terms used in the present specification have the general meaning understood by those skilled in the art to which the present invention pertains unless otherwise defined, and a description for the known function and configuration obscuring the gist of the present invention will be omitted in the following description and the accompanying drawings.

In addition, the singular form used in the present specification may be intended to also include a plural form, unless otherwise indicated in the context.

In addition, units used in the present specification without particular mention is based on weights, and as an example, a unit of % or ratio refers to a wt % or a weight ratio and wt % refers to wt % of any one component in a total composition, unless otherwise defined.

In addition, the numerical range used in the present specification includes all values within the range including the lower limit and the upper limit, increments logically derived in a form and span in a defined range, all double limited values, and all possible combinations of the upper limit and the lower limit in the numerical range defined in different forms. Unless otherwise defined in the specification of the present invention, values which may be outside a numerical range due to experimental error or rounding of a value are also included in the defined numerical range.

The term "comprise" in the present specification is an open-ended description having a meaning equivalent to the term such as "is/are provided", "contain", "have", or "is/are characterized", and does not exclude elements, materials, or processes which are not further listed.

Conventionally, since a high molecular polyethylene fiber is manufactured into a yarn by maximizing crystallinity and an orientation degree for cool feeling expression, the yarn has high strength and low elongation, and thus, has poor weaving properties. In addition, since the manufactured yarn has poor stiffness, its weaving properties are further deteriorated and the drapability and wearability of a fabric manufactured therefrom are not good. Thus, when a real user wears the fabric, a contact area between the user and the fabric is not large, so that a substantial cool feeling effect felt by the user is not excellent.

Thus, the present applicant conducted an intensive study for a long time in order to develop a polyethylene fiber having excellent weaving properties while maintaining cool feeling properties, and as a result, found that a polyethylene fiber having certain polydispersity index, strength, and elongation has excellent weaving properties while having an appropriate thermal conductivity, thereby being manufactured into a fabric having better physical properties, and thus, conducted an in-depth study therefor, thereby completing the present invention.

In the present specification, the polyethylene yarn refers to a monofilament and a multifilament manufactured by a process such as spinning and drawing, using polyethylene chips as a raw material. As an example, the polyethylene fiber may include 40 to 500 filaments each having a fineness of 1 to 3 denier, and may have a total fineness of 100 to 1,000 denier.

The polyethylene yarn of the present invention, which has a polydispersity index (PDI) of 5 or more and 20 or less, a strength of 1.5 to 10 g/d as measured according to ASTM D2256, and an elongation at maximum force of 10 to 50%, has both excellent thermal conductivity and improved weaving properties, and thus, may be manufactured into a fabric having a very low fluff occurrence frequency while having appropriate cool feeling properties.

The cool feeling of a fabric including the polyethylene yarn according to the present invention is a characteristic allowing a user wearing the fabric to feel an appropriate cooling sensation, that is, coolness through a high thermal conductivity of the yarn. Specifically, in the case of a polymer, heat is transferred mainly through lattice vibration called a phonon in the polymer (in particular, in a direction of a molecular chain connected by a covalent bond). That is, the thermal conductivity of the yarn may be adjusted differently depending on the structural characteristics of the polymer itself, such as crystallinity and orientation degree of the yarn, even in the case in which the yarn is a yarn manufactured from the same resin.

As described above, a yarn, which has a polydispersity index (PDI) of 5 or more and 20 or less, a strength of 1.5 to 10 g/d as measured according to ASTM D2256, and an elongation at maximum force of 10 to 50%, may have excellent weaving properties due to its high flexibility with excellent thermal conductivity, and thus, may be manufactured into a fabric having a low fluff occurrence frequency while having high cool feeling properties.

Specifically, the polydispersity index may be 7 or more and 20 or less, or 11 to 16, more specifically, 12 to 15. Here, the strength measured according to ASTM D2256 may be 5 to 10 g/d, or 6 to 9 g/d, specifically 7 to 8 g/d, and the elongation at maximum force may be 10 to 30%, or 15 to 25%, more specifically 17 to 23%, but these are not limited thereto. However, within the ranges, the yarn may have both high thermal conductivity and appropriate high stiffness advantageous for weaving properties.

In particular, when the polyethylene yarn satisfies the following Equation 1 in a weight distribution graph by gel permeation chromatograph (GPC) analysis, with a log scale of a molecular weight (Mw) on the x-axis against a weight distribution (dw/d Log M) on the y-axis, the polyethylene yarn has better thermal conductivity and may be manufactured into a fabric having a very low fluff occurrence frequency. Here, the weight distribution graph is unimodal:

$$(Mw_{max} - Mw_{aver}) < (Mw_{aver} - Mw_{min}) \quad \text{[Equation 1]}$$

wherein $Mw_{aver}$ is a molecular weight having a maximum molecular weight distribution in the weight distribution graph, $Mw_{max}$ and $Mw_{min}$ refer to two molecular weights corresponding to 0.25Q in the weight distribution graph, for a weight distribution value Q at $Mw_{aver}$, and $Mw_{max}$ refers to a maximum value of the two molecular weights and $Mw_{min}$ refers to a minimum value of the two molecular weights.

The polyethylene yarn satisfying Equation 1 has a large weight distribution in a relatively low molecular weight. The polyethylene yarn as such has better weaving properties, due to its high flexibility and strength with excellent thermal conductivity by a phonon, and thus, may be manufactured into a fabric having a very low fluff occurrence frequency.

In addition, since the polyethylene yarn satisfies Equation 1, the value of $(Mw_{max}-Mw_{aver})-(Mw_{aver}-Mw_{min})$ may be negative. As an example, the value may be more than 0 and less than −3, specifically more than 0 and less than −1, and more specifically more than 0 and less than −0.5, but is not limited thereto, of course.

The gel permeation chromatography analysis is performed by completely dissolving a polyethylene yarn in the following solvent and then using the following analytical instrument.

Analytical instrument: HLC-8321 GPC/HT available from Tosoh Corporation

Column: Plgel guard (7.5×50 mm)+2×Plgel mixed-B (7.5×300 mm)

Column temperature: 160° C.

Solvent: trichlorobenzene (TCB)+0.04 wt % of dibutylhydroxytoluene (BHT) (after drying with 0.1% $CaCl_2$)

Injector and detector temperature: 160° C.

Detector: RI Detector

Flow velocity: 1.0 ml/min

Injection amount: 300 mL

Sample concentration: 1.5 mg/mL

Standard sample: polystyrene

In addition, the polyethylene yarn may have an initial modulus lower than that of a common polyethylene yarn for a cool feeling, that is, an initial modulus of 50 to 100 g/d, specifically 30 to 80 g/d, as measured according to ASTM D2256. When the initial modulus of the polyethylene yarn is higher than the range, elasticity may be good but stiffness may be poor, and when the initial modulus of the polyethylene yarn is lower than the range, stiffness may be good but resilience may be low, resulting in poor stiffness of a fabric. That is, the polyethylene yarn may have better weaving properties due to the appropriate stiffness and toughness in the range, and thus, may be manufactured into a fabric having excellent drapability.

In an embodiment, the polyethylene yarn may have a weight average molecular weight of 20,000 to 200,000 g/mol, preferably 30,000 to 150,000 g/mol. When the yarn is melt-extruded within the range, processability is secured, for example, the flowability of a melt during melt extrusion of the yarn is good, occurrence of thermal decomposition is prevented, and breakage during spinning does not occur, thereby manufacturing a yarn having uniform physical properties, and providing a fabric having excellent durability.

In addition, the polyethylene yarn may have a density of 0.93 to 0.97 g/cm$^3$ and a crystallinity by spinning of 50 to 90%, specifically 60 to 85%. The crystallinity of the polyethylene yarn may be derived with a microcrystalline size in crystallinity analysis using an X-ray diffraction analyzer. As described above, heat is rapidly diffused and dissipated through lattice vibration called a "phonon" in a direction of molecular chain connected by a covalent bond of high-density polyethylene (HDPE) in a range in which crystallinity satisfies the range, and a function to discharge moisture such as sweat and breath is improved, thereby providing a fabric having excellent wearability.

Hereinafter, a method for manufacturing a polyethylene yarn according to an embodiment of the present invention will be described in detail, with reference to FIG. 1. The manufacturing method is not limited as long as the polyethylene yarn of the present invention satisfies the range of the physical properties such as PDI, strength, and elongation, and an embodiment is described in the following.

First, polyethylene in the form of chips is introduced into an extruder 100 and melted to obtain a polyethylene melt.

The molten polyethylene is transported through a spinneret 200 by a screw (not shown) in the extruder 100, and extruded through a plurality of holes formed in the spinneret 200. The number of holes of the spinneret 200 may be determined by the denier per filament (DPF) and the fineness of the yarn to be manufactured. For example, when a yarn having a total fineness of 75 deniers is manufactured, the spinneret 200 may have 20 to 75 holes, and when a yarn having a total fineness of 450 deniers is manufactured, the spinneret 200 may have 90 to 450, preferably 100 to 400 holes.

A melting process in the extruder 100 and an extrusion process by the spinneret 200 may be changed and applied depending on the melt index of the polyethylene chips, but specifically, for example, may be performed at 150 to 315° C., preferably 250 to 315° C., and more preferably 265 to 310° C. That is, it is preferred that the extruder 100 and the spinneret 200 may be maintained at 150 to 315° C., preferably 250 to 315° C., and more preferably 265 to 310° C.

When the spinning temperature is lower than 150° C., polyethylene does not melt uniformly due to the low spinning temperature, so that the spinning may be difficult. However, when the spinning temperature is higher than 315° C., thermal decomposition of polyethylene is caused, so that a desired strength may not be expressed.

A ratio (L/D) of a hole length (L) to a hole diameter (D) of the spinneret 200 may be 3 to 40. When L/D is less than 3, die swell occurs during melt extrusion and it becomes hard to control the elastic behavior of polyethylene to deteriorate spinning properties, and when L/D is more than 40, breakage due to necking of molten polyethylene passing through a spinneret and discharge non-uniformity due to pressure drop may occur.

As the molten polyethylene is discharged from holes of the spinneret 200, solidification of polyethylene starts due to a difference between a spinning temperature and room temperature to form filaments 11 in a semi-solidified state. In the present specification, not only the filaments in a semi-solidified state but also completely solidified filaments are collectively referred to as "filaments".

A plurality of filaments 11 are cooled in a cooling unit 300 (or "quenching zone") to be completely solidified. The filaments 11 may be cooled in an air cooling manner.

It is preferred that the cooling of the filaments 11 in the cooling unit 300 may be performed using a cooling air at a wind speed of 0.2 to 1 m/sec so that the filaments are cooled to 15 to 40° C. When the cooling temperature is lower than 15° C., elongation is insufficient due to supercooling so that breakage may occur in a drawing process, and when the cooling temperature is higher than 40° C., a fineness deviation between filaments 11 is increased due to solidification unevenness and breakage may occur in the drawing process.

In addition, multi-stage cooling is performed during cooling in the cooling unit to perform more uniform crystallization, and thus, moisture and sweat may be discharged more smoothly and a yarn having an excellent cool feeling may be manufactured. More specifically, the cooling unit may be divided into three or more sections. For example, when the cooling unit is composed of three cooling sections, it is preferred to design the cooling unit so that the temperature is gradually lowered from a first cooling unit to a second cooling unit. Specifically, for example, the first cooling unit may be set at 50 to 80° C., the second cooling unit may be set at 30 to 50° C., and the third cooling unit may be set at 15 to 30° C.

In addition, a wind speed is set highest in the first cooling unit, thereby manufacturing a fiber having a smoother surface. Specifically, the first cooling unit is cooled to 50 to 80° C. using a cooling wind at a wind speed of 1.0 to 1.5 m/sec, the second cooling unit is cooled to 30 to 50° C. using a cooling wind at a wind speed of 0.6 to 1.0 m/sec, and the third cooling unit is cooled to 15 to 30° C. using a cooling wind at a wind speed of 0.3 to 0.6 m/sec, and by adjusting the cooling units under the conditions as such, a yarn having higher crystallinity and a smoother surface may be manufactured.

Subsequently, the cooled and completed solidified filaments 11 are collected by a collecting machine 400 to form a multifilament 10.

As illustrated in FIG. 1, the polyethylene yarn of the present invention may be manufactured by a direct spinning drawing (DSD) process. That is, the multifilament 10 may be directly transported to a multi-stage drawing unit 500 including a plurality of godet roller units ($GR_1$, . . . Grn),$_n$), subjected to a multi-stage drawing at a total drawing ratio of 2 to 20 times, preferably 3 to 15 times, and then wound up in a winder 600. In addition, in the last drawing section in the multi-stage drawing, a 1 to 5% shrinkage drawing (relaxation) may be imparted to provide a yarn having better durability.

Alternatively, the multifilament 10 are wound up once as an undrawn yarn, and then the undrawn yarn is drawn, thereby manufacturing the polyethylene yarn of the present invention. That is, the polyethylene yarn of the present invention may be manufactured by a two-step process in which polyethylene is melt-spun to manufacture an undrawn yarn once, and then the undrawn yarn is drawn.

When the total drawing ratio applied in the drawing process is less than 2, the polyethylene yarn finally obtained may not have a crystallinity of 60% or more, and there is a risk of causing lint (peeling) on the fabric manufactured by the yarn.

However, when the total drawing ratio is more than 15 times, breakage may occur, the strength of the finally obtained polyethylene yarn is not appropriate, so that the weaving properties of the polyethylene yarn may not be good, and the fabric manufactured using the yarn is too stiff, so that a user may feel uncomfortable.

When a linear speed of the first godet roller unit ($GR_1$) which determines the spinning speed of the melt spinning of the present invention is determined, the liner speeds of the remaining godet roller units are appropriately determined, so that a total drawing ratio of 2 to 20, preferably 3 to 15 may be applied to the multifilament 10 in the multi-stage drawing unit 500.

According to an exemplary embodiment of the present invention, the temperature of the godet roller units ($GR_1$, . . . $GR_n$) in the multi-stage drawing unit 500 is appropriately set in a range of 40 to 150° C., thereby performing heat setting of the polyethylene yarn by the multi-stage drawing unit 500. Specifically, for example, the multi-stage drawing unit may be composed of 3 or more, specifically 3 to 5 drawing sections. In addition, each drawing section may be composed of a plurality of godet roller units.

Specifically, for example, the multi-stage drawing unit may be composed of 4 drawing sections, in which drawing may be performed at a total drawing ratio of 2 to 15 times in a first drawing section to a third drawing section, and then a 1 to 3% shrinkage drawing (relaxation) may be performed in a fourth drawing section. The total drawing ratio refers to a final drawing ratio of a fiber passing through the first drawing section to the third drawing section, as compared with a fiber before drawing.

More specifically, in the first drawing section, drawing may be performed at 40 to 80° C. and a drawing ratio in the first drawing section may be 1.5 to 3 times. In the second drawing section, drawing may be performed at a higher temperature than the first drawing section, specifically at 80 to 130° C., and may be performed so that the drawing ratio of the second drawing section is 1.05 to 3 times. In the third drawing section, drawing may be performed at 100 to 150° C., and may be performed so that the drawing ratio is 1.05 to 3 times. In the fourth section, drawing may be performed at a temperature equivalent to or lower than the second drawing section, specifically at 80 to 140° C., and a 1 to 3% shrinkage drawing (relaxation) may be performed.

The multi-stage drawing and the heat-setting of the multifilament 10 are performed simultaneously by the multi-stage drawing unit 500, and the multi-stage drawn multifilament 10 is wound up in a winder 600, thereby completing the polyethylene yarn of the present invention.

The functional fabric according to the present invention includes the polyethylene yarn described above, and by including the polyethylene yarn having excellent thermal conductivity and high weaving properties, the fabric may have excellent quality with cool feeling properties and fewer defects such as fluff. In addition, by including the polyethylene yarn described above, the functional fabric has excellent drapability as well as a cool feeling, and thus, when a user wears a product made of the fabric as such, a substantially better cool feeling effect may be exerted due to a larger contact area between the user and the product.

The functional fabric according to the present invention may use the polyethylene yarn described above alone, and in order to further impart other functions, a heterogeneous yarn may be further included, but it is preferred to use the polyethylene yarn alone in terms of having both the cool feeling and the weaving properties.

Specifically, the functional fabric may have a cool feeling on contact of 0.15 to 0.45 $W/cm^2$ as measured by bringing the fabric at 20±2° C. into contact with a hot plate (T-box) at 30±2° C. under the conditions of 20±2° C. and 65±2%

R.H, and a thermal conductivity in a thickness direction at 20° C. of 0.01 to 0.30 W/mk as measured by bringing the fabric at 20±2° C. into contact with a heat source plate (BT-box) at 30±2° C. More specifically, the cool feeling on contact may be 0.18 to 0.30 W/cm$^2$ and the thermal conductivity in the thickness direction may be 0.05 to 0.2 W/mk. The functional fabric having a cool feeling as such may provide an appropriate cool feeling to make a user feel comfortable under high temperature environments, when the fabric is manufactured or processed into a product later and worn by the user.

In addition, the functional fabric may have the number of fluff occurrences of 10 or less, specifically 8 or less per 100,000 m$^2$. That is, the functional fabric includes the polyethylene yarn having improved weaving properties, thereby being manufactured into a product having high quality.

The functional fabric may be a woven fabric or knitted fabric having a weight per unit area (that is, surface density) of 150 to 800 g/m$^2$. When the fabric has a surface density of less than 150 g/m$^2$, fabric compactness is insufficient and many pores exist in the fabric, and these pores reduce the cool feeling of the fabric. However, when the fabric has a surface density of more than 800 g/m$^2$, the fabric becomes stiff due to the excessively dense structure of the fabric, problems with user's tactile sensation occur, and problems in use arise due to its high weight.

The fabric as such may be processed into a cool feeling product requiring an appropriate cool feeling. The product may be any conventional fiber product, but preferably, may be summer clothes, sportswear, masks, and work clothes for imparting a cool feeling to a human body.

The cool feeling product of the present invention is manufactured from the fabric described above and has a low stiffness of 5 gf or less, more preferably 2 to 5 gf, thereby having excellent drapability and showing excellent wearability. In addition, since the product shows excellent drapability, when a user wears the product, a contact area with the body of the user is large, so that the cool feeling effect may be substantially better.

Hereinafter, the present disclosure will be described in more detail through the following examples. However, the following exemplary embodiments are only a reference for describing the present invention in detail, and the present invention is not limited thereto, and may be implemented in various forms.

In addition, unless otherwise defined, all technical terms and scientific terms have the same meanings as those commonly understood by a person skilled in the art to which the present invention pertains. The terms used herein are only for effectively describing a certain exemplary embodiment, and not intended to limit the present invention. Further, unless otherwise stated, the unit of added materials herein may be wt %.

The physical properties were measured as follows.

[Measurement of Physical Properties of Yarn]

<1. Weight Distribution Graph, Weight Average Molecular Weight (Mw) (g/Mol), and Polydispersity Index (PDI)>

A polyethylene yarn was completely dissolved in the following solvent and then a weight distribution graph, and the weight average molecular weight (Mw) and the polydispersity index (Mw/Mn: PDI) of the polyethylene yarn were determined, respectively, using the following gel permeation chromatography (GPC).

Analytical instrument: HLC-8321 GPC/HT available from Tosoh Corporation
Column: PLgel guard (7.5×50 mm)+2×PLgel mixed-B (7.5×300 mm)
Column temperature: 160° C.
Solvent: trichlorobenzene (TCB)+0.04 wt % of dibutylhydroxytoluene (BHT) (after drying with 0.1% $CaCl_2$)
Injector, Detector temperature: 160° C.
Detector: RI Detector
Flow velocity: 1.0 ml/min
Injection amount: 300 mL
Sample concentration: 1.5 mg/mL
Standard sample: polystyrene <2. Strength (g/d), Initial Modulus (g/d), and Elongation (%)>

According to the method of ASTM D2256, a universal tensile tester available from Instron (Instron Engineering Corp, Canton, Mass) was used to obtain a strain-stress curve of the polyethylene yarn. A sample length was 250 mm, a tensile speed was 300 mm/min, and an initial load was set to 0.05 g/d. The strength (g/d) and the elongation (%) were obtained from a stress and a stretch at break, and the initial modulus (g/d) was determined from a tangent to impart a maximum gradient near the starting point of the curve. The measurement was performed five times for each yarn and the average value was calculated.

<3. Crystallinity>

An XRD instrument (X-ray Diffractometer) [manufacturer: PANalytical, model name: EMPYREAN] was used to measure the crystallinity of the polyethylene yarn. Specifically, the polyethylene yarn was cut to prepare a sample having a length of 2.5 cm, the sample was fixed to a sample holder, and the measurement was performed under the following conditions:

Light source (X-ray Source): Cu-Kα radiation
Power: 45 KV×25 mA
Mode: continuous scan mode
Scan angle range: 10 to 40°
Scan speed: 0.1°/sec

[Measurement of Physical Properties of Fabric]

<1. Cool Feeling on Contact>

The Korea Apparel Testing & Research Institute was commissioned to perform measurement under 20±2° C. and 65±2% R.H, using a KES-F7 device (Thermo Labo II).

Specifically, a fabric sample having a size of 20 cm×20 cm was prepared, and was allowed to stand for 24 hours under the conditions of a temperature of 20±2° C. and 65±2% RH. Subsequently, a KES-F7 THERMO LABO II device (Kato Tech Co., LTD.) was used to measure a cool feeling on contact (Q max) of the fabric under the test environments of a temperature of 20±2° C. and 65±2% RH. Specifically, as illustrated in FIG. 2, the fabric sample 23 was placed on a base plate (also referred to as "Water-Box") 21 maintained at 20 C, and a hot plate (T-Box, 22a) heated to 30° C. (contact area: 3 cm×3 cm) was placed on the fabric sample 23 only for 1 second. That is, the other surface of the fabric sample 23 of which one surface was in contact with a base plate 21 was momentarily brought into contact with T-Box 22a. A contact pressure applied to the fabric sample 23 by the T-Box 22a was 6 gf/cm$^2$. Subsequently, a Q max value displayed in a monitor (not shown) connected to the device was recorded. The test was repeated 10 times, and an arithmetic mean of the Q max value was calculated.

<2. Thermal Conductivity>

A fabric sample having a size of 20 cm×20 cm was prepared, and was allowed to stand for 24 hours under the conditions of a temperature of 20±2° C. and 65±2% RH. Subsequently, a KES-F7 THERMO LABO II device (Kato Tech Co., LTD.) was used to determine the thermal conductivity and the heat transfer coefficient of the fabric under the test environments of a temperature of 20±2° C. and 65±2% RH. Specifically, as illustrated in FIG. 3, the fabric sample 23 was placed on the base plate 21 maintained at 20° C., and a heat source plate (BT-Box, 22b) at 30±2° C. (contact area: 5 cm×5 cm) was placed on the fabric sample 23 for 1 minute. Heat was continuously supplied to the BT-Box 22b so that the temperature was maintained at 30° C. even while the BT-Box 22b was in contact with the fabric sample 23. A heat quantity supplied for temperature maintenance of the BT-Box 22b (that is, heat flow loss) was displayed on a monitor connected to the device. The test was repeated 5 times, and an arithmetic mean of the heat flow loss was calculated. Subsequently, the thermal conductivity and the heat transfer coefficient of the fabric were calculated using the following Equations 2 and 3:

$$K = (W \cdot D)/(A \cdot \Delta T) \quad \text{[Equation 2]}$$

$$k = K/D \quad \text{[Equation 3]}$$

wherein K is thermal conductivity (W/cm.° C.), D is a thickness of the fabric sample 23, A is a contact area (=25 $cm^2$) of the BT-Box 22b, ΔT is a temperature difference (=10° C.) between both surfaces of the fabric sample 23, W is heat flow loss (Watt), and k is a thermal transfer coefficient ($W/cm^2$.° C.).

<3. Stiffness (gf)>

A fabric sample (horizontal: 60 mm, vertical: 60 mm) was taken, and the stiffness of the specimen was measured according to section 38 of ASTM D885/D885M-10a (2014). The measurement devices were as follows:

(i) CRE-type Tensile Testing Machine (model: INSTRON 3343)

(ii) Loading Cell, 2 KN [200 kgf]

(iii) Specimen Holder: a specimen holder specified in section 38.4.3

(iv) Specimen Depressor: a specimen depressor specified in section 38.4.4

Specifically, the sample was placed on the center of a specimen holder so that the sample was directly supported by the specimen holder. The sample was maintained in a flat stage without being bent. At this time, a distance between the sample supporting part of the specimen holder and the depressing part of the specimen depressor was 5 mm. Subsequently, the specimen holder was raised up to 15 mm while the specimen depressor was allowed to stand motionless, thereby measuring a maximum tension.

Example 1

<Manufacture of Polyethylene Yarn>

A device illustrated in FIG. 1 was used to manufacture a polyethylene yarn including 200 filaments and having a total fineness of 150 denier.

Specifically, polyethylene chips were added to an extruder 100 and melted. The molten polyethylene was extruded through a spinneret 200 having 200 holes. L/D which is a ratio of a hole length (L) to a hole diameter (D) of the spinneret was 6. A spinneret temperature was 270° C.

Filaments 11 formed by being discharged from nozzle holes of the spinneret 200 were sequentially cooled in a cooling unit 300 composed of three sections. The filaments were cooled to 70° C. by a cooling wind at a wind speed of 1.2 m/sec in a first cooling unit, cooled to 40° C. by a cooling wind at a wind speed of 0.8 m/sec in a second cooling unit, and finally cooled to 20° C. by a cooling wind at a wind speed of 0.4 m/sec in a third cooling unit. The filaments were collected into a multifilament yarn 10 by a collecting machine 400.

Subsequently, the multifilament yarn was transported to a drawing unit 500. The drawing unit was a multi-stage drawing unit composed of four sections, and specifically, drawing and heat setting were performed by drawing at a total drawing ratio of 1.5 times at a highest drawing temperature of 70° C. in a first drawing section, drawing at a total drawing ratio of 2.0 times at a highest drawing temperature of 100° C. in a second drawing section, drawing at a total drawing ratio of 1.5 times at a highest drawing temperature of 120° C. in a third drawing section, and 2% shrinkage drawing (relaxation) as compared with the third drawing section at a highest drawing temperature of 125° C. in a fourth drawing section.

Subsequently, the drawn multifilament yarn was wound up in a winder 600. A winding tension was 0.8 g/d.

The physical properties of the thus-manufactured yarn were measured, and are shown in the following Table 1.

<Manufacture of Functional Fabric>

The polyethylene yarn manufactured above was woven to manufacture a functional fabric having a surface density of 500 $g/m^2$. The physical properties of the thus-manufactured fabric were measured, and are shown in the following Table 3.

Examples 2 to 7

Fabrics were manufactured in the same manner as in Example 1, except that the yarn conditions were changed as shown in Table 1. In addition, the physical properties of the fabric manufactured in the same manner as in Example 1 were measured and are shown in Table 3.

Comparative Examples 1 to 4

Fabrics were manufactured in the same manner as in Example 1, except that the yarn conditions were changed as shown in Table 2. In addition, the physical properties of the fabric manufactured in the same manner as in Example 1 were measured and are shown in Table 4.

TABLE 1

| Classification | | Example 1 | Example 2 | Example 3 | Example 4 | Example 5 | Example 6 | Example 7 |
|---|---|---|---|---|---|---|---|---|
| Physical properties of yarn | PDI | 12.4 | 8.1 | 15.2 | 12.4 | 12.2 | 12.3 | 12.7 |
| | Mw (g/mol) | 82,786 | 128,531 | 147,452 | 114,551 | 916,331 | 79,321 | 84,214 |
| | $(Mw_{max} - Mw_{aver}) - (Mw_{aver} - Mw_{min})$ | −0.13 | −0.10 | −0.12 | −0.15 | −0.70 | 0.11 | 0.15 |

TABLE 1-continued

| Classification | Example 1 | Example 2 | Example 3 | Example 4 | Example 5 | Example 6 | Example 7 |
|---|---|---|---|---|---|---|---|
| Crystallinity (%) | 75.1 | 75.6 | 74.2 | 75.3 | 75.8 | 71.2 | 69.5 |
| Strength (g/d) | 7.2 | 8.2 | 8.8 | 7.5 | 7.3 | 5.7 | 5.8 |
| Initial modulus (g/d) | 50.2 | 72.7 | 79.1 | 68.5 | 64.1 | 75.7 | 73.4 |
| Elongation (%) | 28.4 | 19.7 | 15.2 | 22.7 | 25.5 | 11.2 | 13.4 |

TABLE 2

| | Classification | Comparative Example 1 | Comparative Example 2 | Comparative Example 3 | Comparative Example 4 |
|---|---|---|---|---|---|
| Physical properties of yarn | PDI | 9.6 | 9.5 | 7.7 | 5.0 |
| | Mw (g/mol) | 188,214 | 174,562 | 168,461 | 365,164 |
| | $(Mw_{max} - Mw_{aver}) - (Mw_{aver} - Mw_{min})$ | 0.05 | 0.12 | 0.07 | 0.14 |
| | Crystallinity (%) | 75.1 | 75.5 | 73.1 | 76.0 |
| | Strength (g/d) | 13.8 | 13.0 | 12.7 | 15.5 |
| | Initial modulus (g/d) | 160 | 203 | 141 | 300 |
| | Elongation (%) | 9.4 | 9.0 | 9.8 | 6.5 |

TABLE 3

| Classification | | Example 1 | Example 2 | Example 3 | Example 4 | Example 5 | Example 6 | Example 7 |
|---|---|---|---|---|---|---|---|---|
| Physical properties of yarn | Cool feeling on contact ($W/cm^2$) | 0.208 | 0.207 | 0.210 | 0.202 | 0.248 | 0.198 | 0.192 |
| | Thermal conductivity in thickness direction at 20° C. (w/mK) | 0.163 | 0.161 | 0.163 | 0.151 | 0.188 | 0.124 | 0.134 |
| | Stiffness (g/d) | 3.1 | 3.2 | 3.4 | 4.2 | 4.3 | 5.7 | 4.8 |
| | Fluff occurrence frequency per 100,000 $m^2$ | 2 | 3 | 2 | 1 | 3 | 6 | 7 |

TABLE 4

| | Classification | Comparative Example 1 | Comparative Example 2 | Compa ative Example 3 | Compa ative Example 4 |
|---|---|---|---|---|---|
| Physical properties of yarn | Cool feeling on contact ($W/cm^2$) | 0.112 | 0.115 | 0.082 | 0.092 |
| | Thermal conductivity in thickness direction at 20° C. (w/mK) | 0.09 | 0.12 | 0.07 | 0.13 |
| | Stiffness (g/d) | 6.1 | 7.8 | 7.8 | 7.1 |
| | Fluff occurrence frequency per 100,000 $m^2$ | 13 | 20 | 17 | 11 |

Referring to Tables 1 to 4, it was confirmed that the fabrics according to the examples had an appropriate coal feeling, had excellent drapability with excellent stiffness, and had an extremely low fluff occurrence frequency in manufacture of the fabric to have excellent weaving properties.

In particular, referring to FIG. 4 showing the weight distribution graph by GPC analysis of Example 3, it was confirmed that in the examples satisfying Equation 1, that is, in the examples in which the value of $(Mw_{max}-Mw_{aver})-(Mw_{aver}-Mw_{min})$ was negative, the weaving properties and the coal feeling were better.

Hereinabove, although the present invention has been described by specific matters, limited exemplary embodiments, and drawings, they have been provided only for assisting the entire understanding of the present invention, and the present invention is not limited to the exemplary embodiments, and various modifications and changes may be made by those skilled in the art to which the present invention pertains from the description.

Therefore, the spirit of the present invention should not be limited to the above-described exemplary embodiments, and the following claims as well as all modified equally or equivalently to the claims are intended to fall within the scope and spirit of the invention.

DETAILED DESCRIPTION OF MAIN ELEMENTS

100: extruder
200: spinneret
300: cooling unit
400: collecting machine
500: drawing unit
600: winder

The invention claimed is:

1. A polyethylene yarn having a polydispersity index (PDI) of 5 or more and 20 or less, a strength of 1.5 to 10 g/d as measured according to ASTM D2256, and an elongation at maximum force of 10 to 50%, wherein the polyethylene yarn satisfies the following Equation 1 in a weight distribution graph by gel permeation chromatograph (GPC) analysis, with a log scale of a molecular weight (Mw) on the x-axis against a weight distribution (dw/d Log M) on the y-axis, and the weight distribution graph is unimodal:

$$(Mw_{max} - Mw_{aver}) < (Mw_{aver} - Mw_{min}) \quad \text{[Equation 1]}$$

wherein $Mw_{aver}$ is a molecular weight having a maximum molecular weight distribution in the weight distribution graph, $Mw_{max}$ and $Mw_{min}$ refer to two molecular weights corresponding to 0.25Q in the weight distribution graph, for a weight distribution value Q at $Mw_{aver}$, and $Mw_{max}$ refers to a maximum value of the two molecular weights and $Mw_{min}$ refers to a minimum value of the two molecular weights.

2. The polyethylene yarn of claim 1, wherein the yarn has an initial modulus of 30 to 80 g/d as measured according to ASTM 2256.

3. The polyethylene yarn of claim 1, wherein the yarn has a crystallinity of 60 to 85%.

4. The polyethylene yarn of claim 1, wherein the yarn has a density of 0.93 to 0.97 g/cm$^3$.

5. The polyethylene yarn of claim 1, wherein the yarn has a weight average molecular weight of 90,000 to 400,000 g/mol.

6. A functional fabric comprising the polyethylene yarn of claim 1.

7. The functional fabric of claim 6, wherein the fabric has a cool feeling on contact of 0.15 to 0.30 W/cm$^2$, as measured by bringing the fabric at 20±2° C. into contact with a hot plate (T-box) at 30±2° C. under conditions of 20±2° C. and 65±2% R.H.

8. The functional fabric of claim 6, wherein the fabric has a thermal conductivity of 0.05 to 0.20 W/mK, as measured by bringing the fabric at 20±2° C. into contact with a heat source plate (BT-box) at 30±2° C. under conditions of 20±2° C. and 65±2% R.H.

9. The functional fabric of claim 6, wherein the fabric has a surface density of 150 to 800 g/m$^2$.

10. A cool feeling product manufactured from the fabric of claim 6.

* * * * *